United States Patent [19]

Marcus

[11] Patent Number: 4,724,972

[45] Date of Patent: Feb. 16, 1988

[54] TAMPER EVIDENT CONTAINER

[76] Inventor: Paul Marcus, 85 Pascack Rd., Pearl River, N.Y. 10965

[21] Appl. No.: 869,676

[22] Filed: Jun. 2, 1986

Related U.S. Application Data

[63] Continuation-in-part of Ser. No. 833,359, Feb. 25, 1986, which is a continuation-in-part of Ser. No. 805,612, Dec. 6, 1985, Pat. No. 4,671,420.

[51] Int. Cl.[4] ..... B65D 55/02

[52] U.S. Cl. ..... 215/223; 215/253

[58] Field of Search ..... 215/223, 250, 251, 253, 215/32; 220/266

[56] References Cited

U.S. PATENT DOCUMENTS 4,207,989 6/1980 Ingemann ..... 220/266

*Primary Examiner*—George T. Hall

[57] ABSTRACT

A plastic container is produced as an integral unit comprising a container body, and a cap portion connected thereto. The cap portion has an opening in the top through which the container is filled. A separately produced lid means is adapted to cover and seal the opening in the cap. The cap is initially torn from its position integral with the container body, then placed upon the container as a closure member. A tell-tale flag may be affixed to the cap and body to indicate tampering. When the cap is initially torn from the container body the tell-tale flag is detached. A sealing disc may be provided on an upper portion of the cap. The container body is also provided with vertical and horizontal grooves to accommodate a key portion affixed to the cap to provide a child-resistant feature.

8 Claims, 7 Drawing Figures

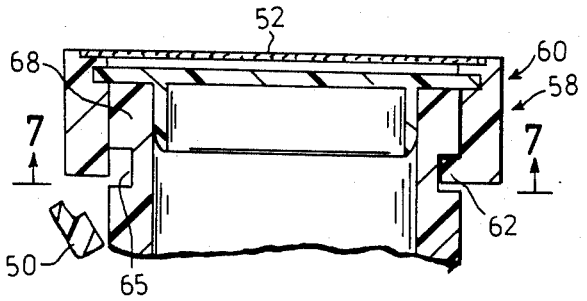
FIG.6
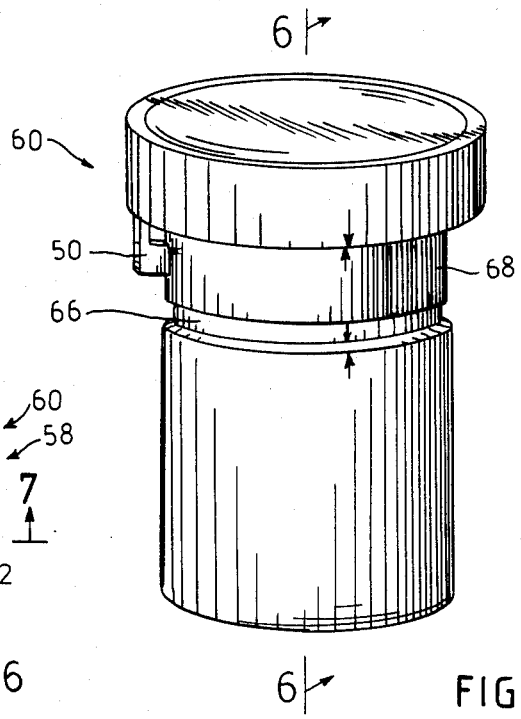
FIG.4
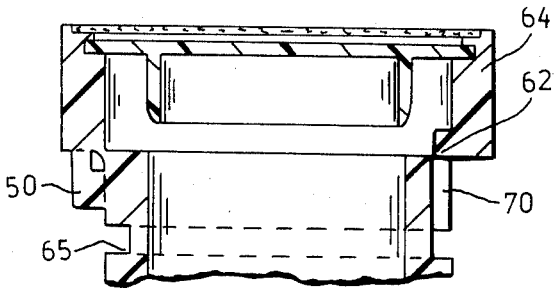
FIG.5
FIG.7
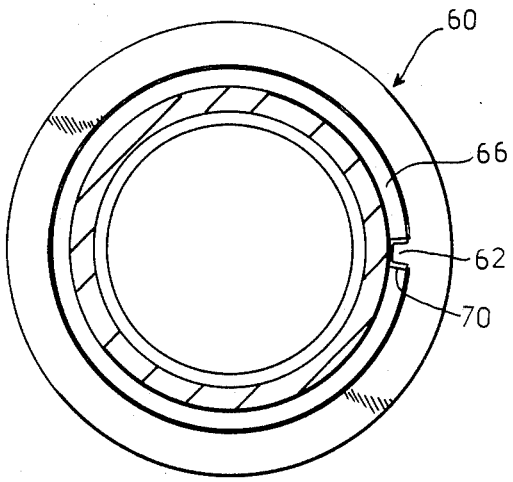

TAMPER EVIDENT CONTAINER

The present application is a continuation-in-part of U.S. Ser. No. 833,359 filed on Feb. 25, 1986, which is a continuation-in-part of U.S. Ser. No. 805,612 filed on Dec. 6, 1985, now U.S. Pat. No. 4,671,420.

FIELD OF THE INVENTION

The present invention pertains to tamper evident containers and more particularly to a plastic container having a cap portion produced integrally therewith.

BACKGROUND OF THE INVENTION

A wide variety of tamper evident containers are known. The Applicant has filed U.S. patent application Ser. No. 805,612 directed to a tamper evident container integrally molded and having a tear strip. Common means for producing tamper evident containers include provision of frangible ribs connecting a removable cap to a semipermanent collar on the bottle neck, enshrouding the container cap with a plastic sheath, provision of one of a variety of tear strip means, and others. However, an integrally molded tamper evident container having the convenience of top filling has not been provided in the prior art.

U.S. Pat. No. 4,019,663 (Krautkramer) discloses a container closure having a tear strip molded as an integral part thereof. However, the Krautkramer closure is not integral with a container body.

U.S. Pat. No. 1,690,441 (Breckenridge) discloses a can having an integral body, tear strip, and cap. The Breckenridge patent does not teach top filling and contains a lid having limited capacity for sealing the contents of the container.

PCT application WO No. 79/00722 (Harild) discloses an integrally molded container having a tear strip wherein the container is filled with product through a bottom opening, and wherein a limited closure means is disclosed for closing the container after removal of the tear strip.

As can be seen from the above, prior art containers having an integral tear strip have not suggested top loading and are extremely limited in their closure capabilities.

SUMMARY OF THE INVENTION

The primary object of the present invention is to provide a tamper evident container of ultimate simplicity in manufacture, having top filling capacity and having an improved closure means.

A further object is to provide a container having a child-resistant feature wherein a key affixed to the cap is adapted to successively ride in vertical and circumferential grooves in the container body. A sealing disc for the cap and a tamper evident flag are also provided.

The invention provides a plastic container having tamper evident and child-resistant features, produced as an integral unit, comprising a container body, a container neck and a cap portion connected to the container body. The cap portion has an opening in the top through which the container is filled. A separately produced lid means is adapted to cover and seal the opening in the cap.

BRIEF DESCRIPTION OF THE DRAWINGS

FIG. 4 is a perspective view of a second embodiment of the invention.

FIG. 5 is a section view of the embodiment of FIG. 4. The cap and container body are affixed as molded.

FIG. 6 is a section view of the device of FIG. 5 wherein the cap has been detached from the container body and re-applied as a closure.

FIG. 7 is a section view taken along line 7—7 of FIG. 5.

DETAILED DESCRIPTION OF THE PREFERRED EMBODIMENTS

Figure 1:
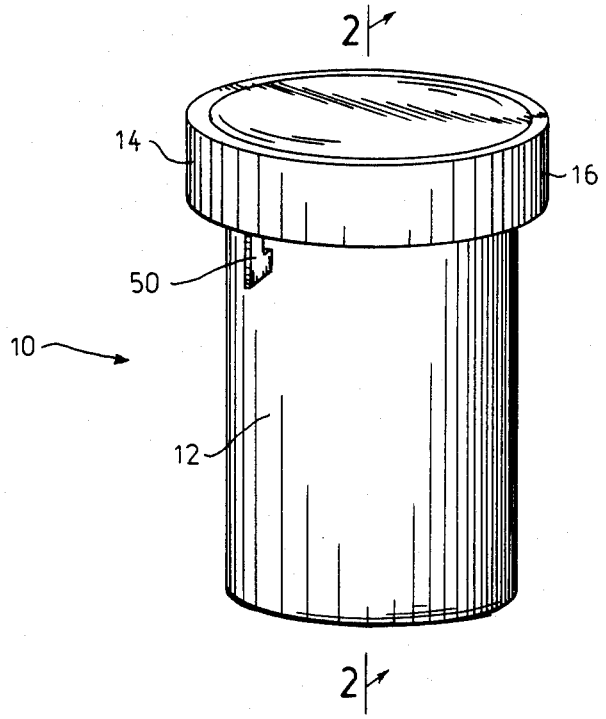
FIG. 1 is a perspective view of a first embodiment of the present invention.

FIG. 1 illustrates a container 10 having a body 12 and a cap 14 with a side wall 16, the cap having a separately-produced lid member 30 affixed therein, the cap and lid member combining to form a closure 58. Container 10 is composed of an integral plastic piece which is preferably manufactured by either injection molding, injection blow molding or extrusion blow molding. Weakened line 24 is disposed between body 12 and cap wall 16. Weakened line 24 facilitates tearing cap 14 from the container body.

A flag 50 is detachably affixed in a break-away manner to container wall 12 and cap 14. The connections between flag 50 and the container components is a weakened connection, illustrated by dotted lines in FIG. 2. The flag is a thin molded flash which is broken off (see FIG. 3) when cap 14 is removed or depressed. Removal of the flag is an indication that container 10 has been opened or tampered with. Flag 50 acts as a reminder to consumers to check for tampering.

Figure 2:
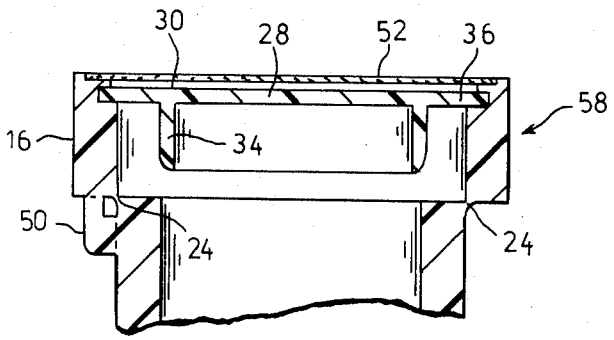
FIG. 2 is a partial side-section view of the embodiment of FIG. 1. The cap and body are affixed as molded.

FIG. 2 is a section view of a first embodiment of the invention. An upper portion of a container and the cap 14 are shown. This view illustrates the cap and body relationship after manufacture and after affixation of lid member 30 to the container. Lid member 30 has a flat disc-shaped portion 28 adapted to seal the opening in container 10. An annular member 34 extends perpendicularly downward therefrom. Flange 36 of disc 28 extends radially outward of the perimeter of the annular member 34. A sealing compound may be applied to secure the seal between lid member 30 and cap 14.

A sealing disc 52 may be applied to the container to evidence tampering and can cover all or part of lid member 30. The sealing disc may be affixed to cap 14 by heat-sealing. Removal of the sealing disc would require breaking the seal, thus indicating to a consumer that the container has been opened.

Figure 3:
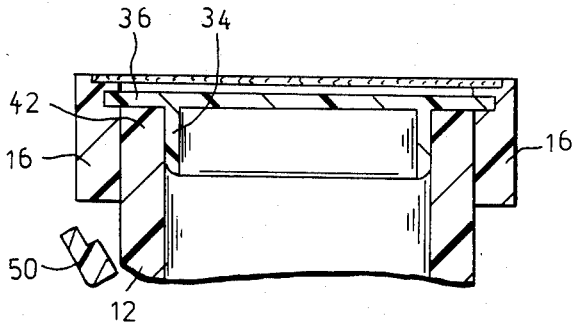
FIG. 3 is a view of the device of FIG. 2, wherein the cap has been detached from the molded position and re-applied to act as a closure.

FIG. 3 is a view of the container of FIG. 2 in a closed position. Flag 50 is shown having been broken away and falling from the container. Annular member 34 has an outer diameter which is substantially equal to the inner diameter of container body 12 so that a friction fit is provided between annular member 34 and container body 12 to seal container 10. Flange 36 rests upon an upper edge 42 of the container neck in a closed position and side wall 16 of cap 14 is disposed outwardly of the neck wall.

To arrive at the "closed" position of FIG. 3, the cap 14 is torn away along weakened line 24 and cap 14 is mounted on container body 12 as shown.

In using the container of the present invention, container 10 is first molded as an integral piece as shown in FIGS. 1 and 2. The container is then filled with product through an aperture in the cap. Lid member 30 is inserted into cap 14, then sealing disc 52 is applied to the cap, sealing the container. The container with product is now ready for consumer use. On first use, cap 14 is torn away from body 12 along weakened line 24. Cap 14 is then removably mounted on body 12 by a friction fit as shown in FIG. 3 for convenient consumer use. The cap may be removed from the container body by pulling or rotating to release the friction fit.

FIGS. 4–7 illustrate a second embodiment of the tamper evident container wherein elements identical to those in the first embodiment have retained the same identification numerals. The second embodiment operates in a manner similar to that of FIGS. 1–3 and incorporates a child-resistant feature. Cap 60 contains a key 62 extending inwardly from the lower edge of side wall 64. FIG. 5 illustrates the container neck and cap portion 60 as molded, comprising a unitary piece. Cap 60 and key 62 connect to the container neck in a breakaway manner so that a consumer can tear the cap from the container and re-apply the cap to the container as shown in FIG. 6. In the preferred construction key 62 is aligned with a vertical groove 70 in the container neck, when in a molded condition (FIG. 5).

A horizontal groove 66 is provided in the container defining a lip portion 68. Vertical groove 70 is contained in the lip portion to accommodate vertical passage of key 62. To apply cap 60 of the second embodiment, the cap is first detached by a consumer from its position as shown in FIG. 5. Key 62 is then aligned with groove 70, and the cap is depressed, key 62 traveling downwardly in groove 70. When cap 60 is depressed and key 62 is aligned with horizontal groove 66, the cap is rotated to disalign key 62 with vertical groove 70, locking cap 60 to the container and providing a child-resistant closure. In order to remove cap 60 from container 58 the cap must first be rotated to align key 62 with vertical groove 70. The cap is then lifted off, key 62 traveling vertically in groove 70. Flag 50 is broken off during detachment and depression of the cap to evidence that the cap has been detached.

FIG. 7 is a view along line 7—7 of FIG. 6. Side wall 64 contains key 62 which is spaced from groove 70 in the locked position.

Although a detailed description of the preferred embodiments of the present invention has been provided, it is to be understood that the scope of the present invention is not to be limited thereby, but is to be determined by the claims which follow.

What is claimed is:

1. A plastic container produced as an integral unit comprising a container body, a cap portion connected to the container body having an opening in a top portion thereof, said container being adapted to be filled with product through the opening in said cap, a separately produced lid means affixed to the cap portion to cover the opening in the cap portion, said lid means cooperating with the cap portion to form a closure means, a sealing disc affixed to the cap portion at an upper edge thereof to seal the opening in the cap portion.

2. The container of claim 1 further comprising a flag affixed in a break-away manner on one end to the cap portion and, on the other end, to the container body.

3. A plastic container produced as an integral unit comprising a container body, a cap portion connected to the container body having an opening in a top portion thereof, said container being adapted to be filled with product through the opening in said cap, a separately produced lid means affixed to the cap portion to cover the opening in the cap portion, said lid means cooperating with the cap portion to form a closure means, the container body containing a lip portion at an upper end thereof, a circumferential groove disposed below the lip portion, and a vertical groove extending the length of the lip portion, and the cap portion contains a side wall having a key extending inwardly and adapted to ride in the vertical and horizontal grooves to provide a child-resistant closure.

4. The container of claim 3 wherein the key comprises a projection of rectangular cross-section extending perpendicularly from the lower edge of the side wall.

5. The container of claim 3 further comprising a flag affixed in a break-away manner on one end to the cap and, on the other end, to the container body, and a sealing disc affixed to the cap portion at an upper end thereof to seal the opening in the cap portion.

6. The container of claim 5 wherein the closure means further comprises a stopper means, said stopper means being adapted to close an opening in the container neck after removal of the cap from the container, the position wherein the stopper means closes the opening in the container neck defining a closed position.

7. The container of claim 6 wherein the cap portion is affixed to the container body along a circumferential weakened line, the portion of the cap affixed to the container body being a radially outward portion of the cap, the stopper means being located spaced from and interiorly thereof.

8. The container of claim 7 wherein the lid means of the closure means comprises a flat top portion and the annular member is affixed to the bottom side of the flat top portion extending substantially perpendicularly therefrom, the annular member having an outside diameter substantially equivalent to an inside diameter of the container neck, said closure means adapted to seal the opening, which is created in the container neck after removal of the cap, by a friction fitting.

* * * * *